United States Patent [19]

Egbers et al.

[11] 4,002,019

[45] Jan. 11, 1977

[54] METHOD OF MAKING YARNS FROM ANGORA RABBIT'S-WOOL AND YARNS SO MADE

[75] Inventors: Gerhard Egbers, Eningen; Peter Artzt, Reutlingen, both of Germany

[73] Assignee: Patentverwertungs-AG der Spinnerei am Uznaberg, Ballen, Switzerland

[22] Filed: July 21, 1975

[21] Appl. No.: 597,454

[30] Foreign Application Priority Data

July 22, 1974 Switzerland ..... 10092/74

[52] U.S. Cl. ..... 57/140 BY; 57/156; 57/157 AS

[51] Int. Cl.[2] ..... D02G 3/02; D02G 3/04

[58] Field of Search ..... 57/139, 140 BY, 140 C, 57/140 R, 144, 149, 152, 153, 156, 160, 162, 164, 157 AS, 5, 6, 7

[56] References Cited

UNITED STATES PATENTS

| | | | |
|---|---|---|---|
| 2,043,333 | 6/1936 | Purdy | 57/139 |
| 2,155,648 | 4/1939 | Frenkel | 57/153 |
| 2,193,894 | 3/1940 | Whitehead | 57/140 C |
| 2,407,105 | 9/1946 | Seymour et al. | 57/140 C |
| 2,595,977 | 5/1952 | Peckham et al. | 57/157 AS X |
| 3,723,173 | 3/1973 | Schonfeldt | 57/153 X |

FOREIGN PATENTS OR APPLICATIONS

| | | | |
|---|---|---|---|
| 916,155 | 8/1954 | Germany | 57/140 BY |

*Primary Examiner*—Donald E. Watkins
*Attorney, Agent, or Firm*—Howard C. Miskin

[57] ABSTRACT

Yarn of a fineness between Nm 60 and Nm 250 comprises fibres from the fur of angora rabbits. The fibres are pretreated with a two-component composition of an antistatic agent and an agent for increasing the adhesibility of the fibres. The pretreated fibres, with or without other fibres such as synthetic fibres, are spun together with an uninterrupted carrier thread of a cross-section up to one third of the cross-section of the spun yarn.

10 Claims, No Drawings

METHOD OF MAKING YARNS FROM ANGORA RABBIT'S-WOOL AND YARNS SO MADE

The invention relates to a method of making yarns with a fineness of Nm 60 to about Nm 250 from angora rabbit's-wool and synthetic or other artificial fibres. (Nm is the metric number or 'count' used for yarn on the Continent of Europe)

Angora wool is the term for the hair of the angora rabbit. The fineness of the individual angora fibres amounts to 0.012 to 0.017 mm and their length 12 to 100 mm. Despite this fineness (angora wool is the finest existing natural fibre) the angora fibre possesses cavities in which air is occluded. It is these air occlusions that give angora its characteristic properties, namely its high thermal insulation and its extreme lightness in weight.

The spinning of angora wool to form yarn is made particularly difficult by so-called bristly hair (kemp). Further difficulties during processing arise out of the intensive electrostatic charging and the smooth surface of the fibres. As a result of a combination of these properties, angora wool could hitherto be spun industrially to form only coarse yarns, generally up to Nm 40. Finer yarns could not be spun industrially and consequently finer finished goods could not be produced. However, coarse yarns necessarily lead to a high weight of the piece goods and, by reason of the high cost of angora wool, this means a high cost for the finished articles.

The proportion of bristly hair is between 0.4 and 8.6% of the shearing yield for the angora rabbit. The bristly hairs are not only longer than the normal angora fibres but their cross-sectional area is also a multiple thereof. In the spun yarn, one bristly hair displaces approximately ten normal angora fibres. Although the stiffness of the bristly hair is correspondingly greater, its tear strength is less than that of normal angora fibres. The bristly hairs cause special problems during spinning because they behave entirely differently from normal angora fibres. As a result of their specific properties, they can be spun in only poorly and they often project from the spun formation during spinning. By reason of their larger cross-section, they displace the normal angora fibres and consequently it was hitherto possible to make only coarser angora yarns in which one could be sure that even in the region of the bristly hairs one would obtain about 80 fibres in the cross-section of the material to be spun or the yarn, which is the minimum number required for efficient spinning. The tear strength of the material to be spun and the yarn must be at least so high that continuous spinning of the material or undisturbed further processing of the yarn during weaving or knitting is facilitated. Because of the specific properties of the angora wool, these prerequisites existed only for coarse angora yarns of a fineness generally not exceeding Nm 40. Attempts to produce finer yarns from angora wool led to thread breakages and interruptions in the spinning process.

The present invention aims to provide a method for industrially making from angora wool yarns that are finer than Nm 60, which will facilitate undisturbed manufacture.

According to the invention, a two-component finishing agent is applied to the angora rabbit's-wool prior to spinning, one of the components being an antistatic agent and the other an agent for increasing the adhesability, and the angora rabbit's-wool is spun with an uninterrupted carrier thread which binds the fibres and has a cross-sectional area no more than one third of the cross-sectional area of the yarn.

In the manufacture of yarns from angora rabbit's-wool, it was hitherto considered necessary that the yarn cross-section should contain at least about 80 fibres in the statistic mean in order to keep the spinning process in progress. When using fewer fibres tears occurred in the spinning triangle during spinning because the fibres that here extend substantially parallel to one another found inadequate adhesion to one another if the number of fibres dropped below a permissible figure, which can be expected frequently by reason of the bristly hairs that are present in the angora rabbit's-wool. The method of the invention now permits these 'points of weakness' to be bridged during the spinning process. The uninterrupted thread that is also spun in accordance with the invention thereby assumes a dual function.

Firstly, it prevents the loose bond of the substantially parallel fibres in the spinning triangle from fracturing on the occurrence of a sudden reduction in the number of fibres; this is because it maintains the connection to succeeding fibres and thereby bridges points of weakness.

Secondly, the uninterrupted thread that is spun in binds the staple fibres so that their adhesion to one another is improved by already increasing the frictional pressure in the spinning triangle. To ensure that the uninterrupted spun carrier thread binds the staple fibres and entwines them, it is desirable to feed it eccentrically.

German Patent Specification 916,155 discloses an angora thread in which a central core thread has a covering of angora fibres spun around it. It is stated that the strength of the thread is primarily determined by the high strength of the thread that is embedded as the core, whilst the covering alone imparts the angora character. In the yarn made by the method of the invention, the uninterrupted spun-in carrier thread, that is used as a 'spinning aid' and must not be confused with the known core thread, no longer contributes to the strength of the yarn. Without markedly reducing the strength of the yarn, it could be removed after spinning because it only serves to bind the staple fibres and thereby maintain the spinning process. In the yarn known from German Specification 916,155, the core thread forms an independent component of the spun product and is preferably even independently spun with a different twist from that of the covering of angora rabbit's-wool.

By applying a two-component finishing agent to the material to be spun in accordance with the invention, the spinability of the angora wool to form fine yarns is achieved. The strong electrostatic charge of angora wool hitherto led to electrostatic adhesion of the fibres to the machine parts, particularly in the case of the machinery used preparatory to spinning, and thereby gave rise to faults and interruptions in the process. The like electrostatic charging causes the individual fibres to repel one another so that the required adhesion to one another of the fibres is lost and the fibre bond required for the spinning process is weakened. In the very attempt to produce finer yarns, the higher speeds gave rise to higher electrostatic charges which additionally made the production of finer yarns appear impossible. The first component of the finishing agent, the antistatic agent, counteracts the electrostatic charge resulting during processing of the angora wool from friction of the individual fibres between one another and with the machine parts.

Apart from its intensive electrostatic chargeability, angora wool has, in comparison with other materials to be spun, a smooth fibre surface which further reduces the adhesion of the fibres to one another. The second component of the finishing agent increases the adhesability of the individual angora fibres, the untreated surface of which is so smooth that normal spinning is made difficult. Both components of the finishing agent are made chemically compatible so that they support rather than hinder one another in their specific function. The finishing agent is so finely applied to the material to be spun that the fibres are not cemented together.

The manufacture of the fine yarns in accordance with the invention becomes possible only by spinning the angora rabbit's-wool that has been pretreated with the two-component finishing agent with the carrier thread in accordance with the invention. By means of the carrier thread, which is preferably a monofilament, one achieves a continuous fibre bond, so that the material to be spun has the strength required to maintain the spinning process even in those places where bristly hairs are located and the number of fibres in the cross-section of the yarn would be insufficient for normal spinning. The cross-sectional area of the carrier thread should be no more than one third of the cross-sectional area of the yarn so as to ensure that the required number of fibres always lies adjacent one another in the material to be spun. The fineness of the core thread, which is preferably ultra-strong, amounts to about Nm 800.

From Belgian Patent Specification 669,590 it is known to use synthetic fibre mixtures of which a predominant proportion contains a permanent antistatic agent whilst the remainder of the fibres contains a substance which increases friction. In comparison with that prior art, the angora rabbit's-wool is treated with a two-component finishing agent according to the present invention.

The essence of the invention is to be regarded as using the endless carrier thread to maintain a continuous spinning process even in places where the process would be interrupted in the absence of a carrier thread. By means of the process according to the invention, angora rabbit's-wool can be spun to such fine yarns that were hitherto regarded impossible.

Desirably, synthetic or other artificial fibres can be mixed as staple fibres with the angora rabbit's-wool that is to be spun together with an endless synthetic carrier thread. These admixed fibres do not affect the angora character of the yarn. The ability to spin fine yarns is further improved by the uniformity of these staple fibres. In order not to influence the angora character, the proportion of the synthetic or other artificial fibres preferably amounts to between 20 and 70%. The synthetic staple fibres can consist of polyester with a staple of preferably 38 mm.

The utility of finished goods made from angora rabbit's-wool was hitherto reduced by reason of the fact that the so-called Pilling effect occurred with surface structures made from angora wool, for example woven and knitted goods. This effect occurs during rubbing of surface structures, which gives rise to small fibre knots (matting) on the surface. With yarns made by the method of the invention and having a considerably strengthened fibre bond because of the endless carrier thread, the Pilling effect is avoided.

In accordance with the invention it was found that when spinning angora rabbit's-wool by using an endless carrier thread, a continuous uninterrupted spinning process is maintained even if the material to be spun contains bristly hair and consequently an insufficient number of individual fibres in the cross-section of the material. The adhesion of the individual fibres to one another is considerably increased by the method of the invention. In addition, the bristly hairs that would otherwise resist being bound in the material to be spun are kept within the fibre bond.

The method of the invention for the first time permits the industrial manufacture of fine high-quality yarns from angora wool. By reason of the fineness of these yarns, the goods made therefrom have a particularly low individual weight. The consequent low consumption of material permits a corresponding reduction in the cost of the finished goods.

We claim:

1. A method of making yarns with a fineness of Nm 60 to about Nm 250 from angora rabbit's-wool and synthetic fibres or other artificial fibres, characterised in that a two-component finishing agent is applied to the angora rabbit's-wool prior to spinning, one of the components being an antistatic agent and the other an agent for increasing the adhesability, and that the angora rabbit's-wool is spun with an uninterrupted carrier thread which binds the fibres and has a cross-sectional area no more than one third of the cross-sectional area of the yarn.

2. A method according to claim 1, characterised in that the uninterrupted carrier thread is fed eccentrically before the yarn is twisted.

3. A method according to claim 1 wherein the angora wool has synthetic or other artificial staple fibres mixed to it.

4. A method according to claim 1 further including applying a two-component finishing agent to the admixed synthetic or other artificial staple fibres, one component being an antistatic agent and the other an agent for increasing the adhesability of the fibres.

5. A method according to claim 1 wherein the fineness of the carrier thread is about Nm 800.

6. A method according to claim 1 wherein the carrier thread comprises a monofilament.

7. A method according to claim 3, wherein the proportion of synthetic or other artificial staple fibres is between 20 and 70% of the entire fibre weight.

8. A method according to claim 3 wherein the synthetic fibres consist of polyester and preferably have a length of about 38 mm.

9. A yarn having a fineness between Nm 60 to about Nm 250 made in accordance with the method of claim 1.

10. Yarn of a fineness between Nm 60 and Nm 250 comprising fibres from the fur of angora rabbits, which fibres have been pretreated with a two-component composition of an antistatic agent and an agent for increasing the adhesability of the angora fibres, said fibres being spun together with an uninterrupted carrier thread of a cross-sectional area up to one third of the spun yarn.

* * * * *